US006871699B1

(12) United States Patent
Boyd et al.

(10) Patent No.: US 6,871,699 B1
(45) Date of Patent: Mar. 29, 2005

(54) ENGINE COOLANT CONDUIT WITH INTEGRAL ALTERNATOR AND EXHAUST GAS RECIRCULATION VALVE

(75) Inventors: Richard C. Boyd, Williamston, MI (US); Michael R. Brosseau, Rochester, NY (US); Daniel F. Smith, Conesus, NY (US); Curtis D. Lamb, Scottsville, NY (US); Keith A. Confer, Flushing, MI (US)

(73) Assignee: Delphi Technologies, Inc., Troy, MI (US)

( * ) Notice: Subject to any disclaimer, the term of this patent is extended or adjusted under 35 U.S.C. 154(b) by 393 days.

(21) Appl. No.: 09/807,086

(22) PCT Filed: Aug. 15, 2000

(86) PCT No.: PCT/US00/22305

§371 (c)(1),
(2), (4) Date: Jun. 26, 2001

(87) PCT Pub. No.: WO01/12962

PCT Pub. Date: Feb. 22, 2001

Related U.S. Application Data

(60) Provisional application No. 60/149,141, filed on Aug. 16, 1999.

(51) Int. Cl.[7] ..... F28F 7/00; F01P 1/06

(52) U.S. Cl. ..... 165/80.4; 165/51; 123/41.31; 310/54

(58) Field of Search ..... 165/51, 80.4, 202; 123/41.31, 123/41.28, 568.12; 310/54, 64, 58

(56) References Cited

U.S. PATENT DOCUMENTS

| | | | | |
|---|---|---|---|---|
| 4,267,812 | A * | 5/1981 | Aula et al. | 123/568.16 |
| 4,358,051 | A * | 11/1982 | Hunt | 236/34.5 |
| 4,864,974 | A | 9/1989 | Aso | |
| 4,922,148 | A * | 5/1990 | Kitamura | 123/41.31 |
| 4,938,176 | A * | 7/1990 | Tanaka et al. | 123/568.17 |
| 5,040,493 | A * | 8/1991 | Gajewski et al. | 310/54 |
| 5,623,175 | A | 4/1997 | Ronning et al. | |
| 5,666,930 | A | 9/1997 | Elder | |
| 5,690,082 | A | 11/1997 | Tanioka et al. | |
| 5,970,960 | A * | 10/1999 | Azuma | 123/568.16 |
| 6,072,253 | A * | 6/2000 | Harpenau et al. | 310/54 |
| 6,189,519 | B1 | 2/2001 | Press et al. | |
| 6,247,461 | B1 | 6/2001 | Smith et al. | |
| 6,390,077 | B1 | 5/2002 | Simpson et al. | |

(Continued)

FOREIGN PATENT DOCUMENTS

JP 407259657 A * 10/1995

*Primary Examiner*—Tho V Duong
(74) *Attorney, Agent, or Firm*—Scott A. McBain

(57) ABSTRACT

In a preferred embodiment, an engine coolant crossover assembly includes a crossover conduit member carrying an integral liquid cooled alternator and liquid cooled exhaust gas recirculation valve. The integration of one or both of these parts into the coolant crossover eliminates many parts from the total assembly. These parts include; attachment brackets, coolant hoses, hose clamps, cast mounting blocks, coolant tubes and attachment bolts. Reduction of these parts reduces system costs, assembly time, mass and potential coolant leak paths. A temperature sensor and a thermostat housing may also be included in the crossover assembly. The assembly may also be made part of an intake manifold for an integrated air fuel module of a V-type engine.

2 Claims, 3 Drawing Sheets

U.S. PATENT DOCUMENTS 6,390,078 B1 5/2002 Gee et al.
6,422,245 B1 7/2002 Song
6,435,168 B1 8/2002 Bircann et al.
6,467,959 B1 10/2002 Bircann
6,497,225 B1 12/2002 Bircann et al.
6,604,542 B1 8/2003 Bircann et al.

* cited by examiner

ENGINE COOLANT CONDUIT WITH INTEGRAL ALTERNATOR AND EXHAUST GAS RECIRCULATION VALVE

CROSS REFERENCE TO RELATED APPLICATION

This application claims the benefit of U.S. Provisional Patent Application No. 60/149,141, filed Aug. 16, 1999.

TECHNICAL FIELD

This invention relates to engine cooling and to cooling of engine accessories mounted within a conduit member such as a coolant crossover member.

BACKGROUND OF THE INVENTION

Increased use of electronics and electrical devices on automobiles has increased the load on charging systems and driven a need for more efficient higher output alternators. A method used to increase the efficiency of the alternators is to liquid cool them rather than the traditional air-cooling. These liquid cooled alternators use the engine coolant, routed through the outer housing of the unit, to cool the electronics and allow more efficient internal geometry. Normally the alternator is bracket mounted to the front of the engine and the coolant is routed to the alternator via a flexible line secured by clamps. A second set of hoses and clamps then routes the coolant from the alternator back to the engine coolant system.

Exhaust gas recirculation valves (EGR) also need to be liquid cooled to improve their performance and extend their usable life. Traditionally engine coolant is passed through an EGR valve mounting block or pedestal. The EGR is an emissions control device that admits exhaust gas into the inlet air of the engine. This exhaust gas is allowed into the intake air during certain engine operating conditions and is used to control the tail pipe emissions of the engine. The high temperature of the exhaust gas, that the valve controls, drives the need for valve cooling.

A coolant crossover, traditionally used on a V style internal combustion engine, carries the engine coolant from one bank of the engine to the opposite bank as part of the engine coolant circuit. This coolant crossover is commonly part of the intake manifold, or can be a separate stand-alone part, and frequently contains the housing for the coolant thermostat and provisions to mount the coolant temperature-sending unit.

SUMMARY OF THE INVENTION

The present invention provides an external coolant conduit member such as an engine coolant crossover, intake manifold or other conduit member mountable between engine components, such as cylinder heads, in a coolant circuit of an engine. The conduit member includes a body defining a coolant passage extending between an inlet and an outlet to the passage. A first mount is provided for mounting in the body an electrical generating device, such as an alternator, in heat transmitting relation to the coolant passage between the inlet and outlet. A second mount may be provided for mounting a second engine accessory, such as an EGR valve, in heat transmitting relation to the coolant passage between the inlet and outlet.

The invention also provides an external coolant conduit assembly having a conduit member, such as a coolant crossover optionally integrated with a manifold. The assembly includes an alternator, or other electrical generating device, and an EGR valve, or other engine accessory, mounted in the conduit member in heat transmitting relation to a coolant passage therein for cooling the integrated elements. The assembly may also include features such as a mounting for a thermostat and a coolant temperature sensor mounted in the conduit member and extending into the coolant passage.

The integration of these features to a coolant crossover eliminates many parts from the total engine assembly. These parts include; attachment brackets, coolant hoses, hose clamps, cast mounting blocks, coolant tubes and attachment bolts. Reduction of these parts reduces system costs, reduces system assembly time, reduces vehicle mass and eliminates many potential coolant leak paths.

These and other features and advantages of the invention will be more fully understood from the following description of certain specific embodiments of the invention taken together with the accompanying drawings.

DESCRIPTION OF THE PREFERRED EMBODIMENT

In a preferred embodiment, the invention provides an engine coolant crossover with an integral liquid cooled alternator and cooled exhaust gas recirculation valve. The integration of one or both of these parts to the coolant crossover eliminates many parts from the total assembly. These parts include; attachment brackets, coolant hoses, hose clamps, cast mounting blocks, coolant tubes and attachment bolts. Reduction of these parts reduces system costs, assembly time, mass and potential coolant leak paths.

Figure 1:
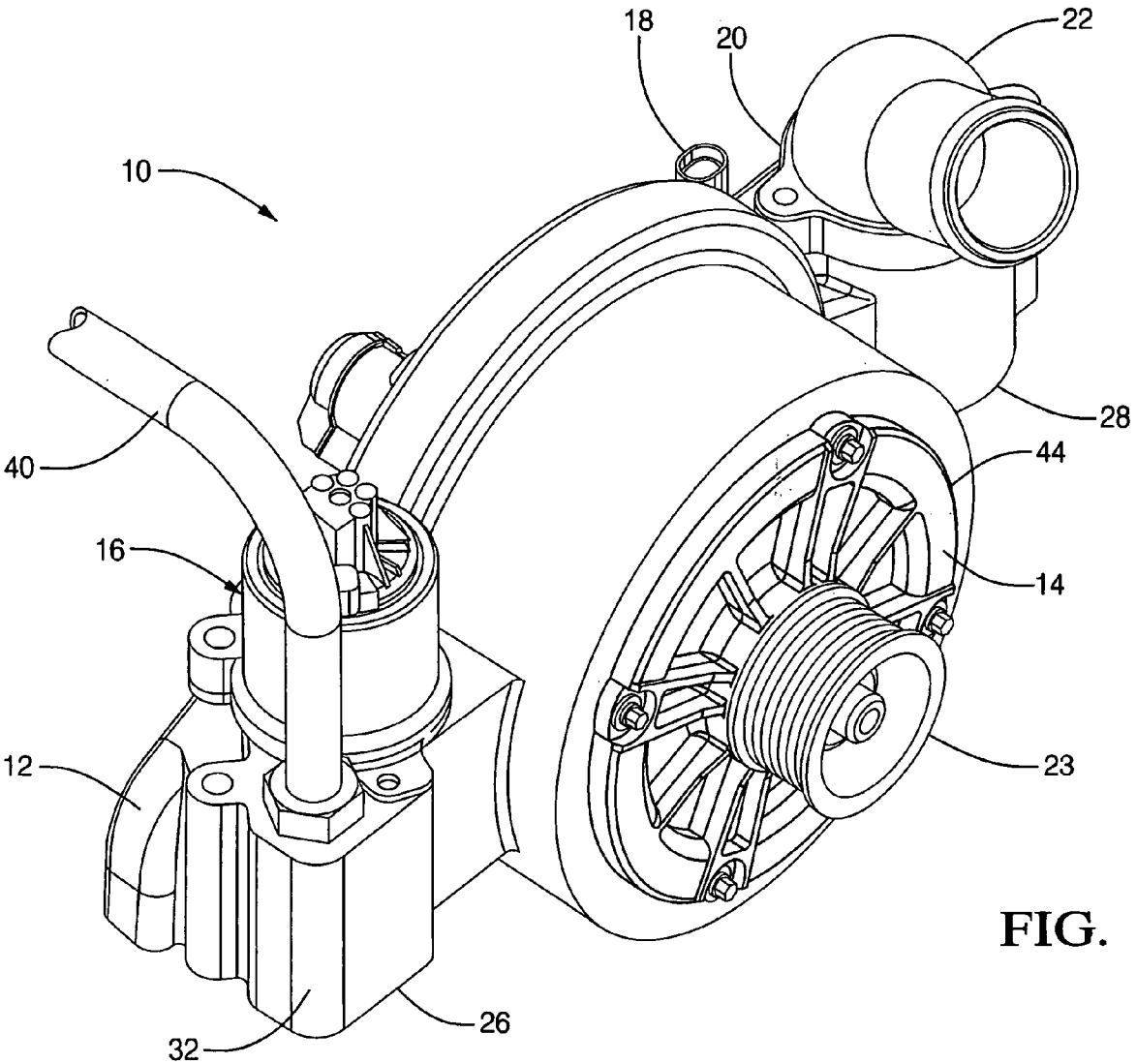
FIG. 1 is a pictorial view of a coolant crossover assembly with integrated alternator, EGR valve and other elements according to the invention.

Referring first to FIG. 1 of the drawings in detail, numeral 10 generally indicates a coolant crossover assembly for use with a V-type engine. The assembly is intended for mounting on the cylinder heads of the engine or on coolant passage defining portions of a cylinder block, not shown. Crossover assembly 10 includes a conduit or crossover member having a body 12 in which are preferably mounted an alternator 14, an exhaust gas recirculation (EGR) valve 16, a coolant temperature sensor 18 and a thermostat, not shown, mounted in a housing 20 of the body 12. A thermostat cover 22 mounts on the housing 20 and retains the thermostat in its operating position in the housing. A pulley 23 is mounted on the front of the alternator for driving the alternator by a drive belt from an associated engine, not shown.

Figure 2:
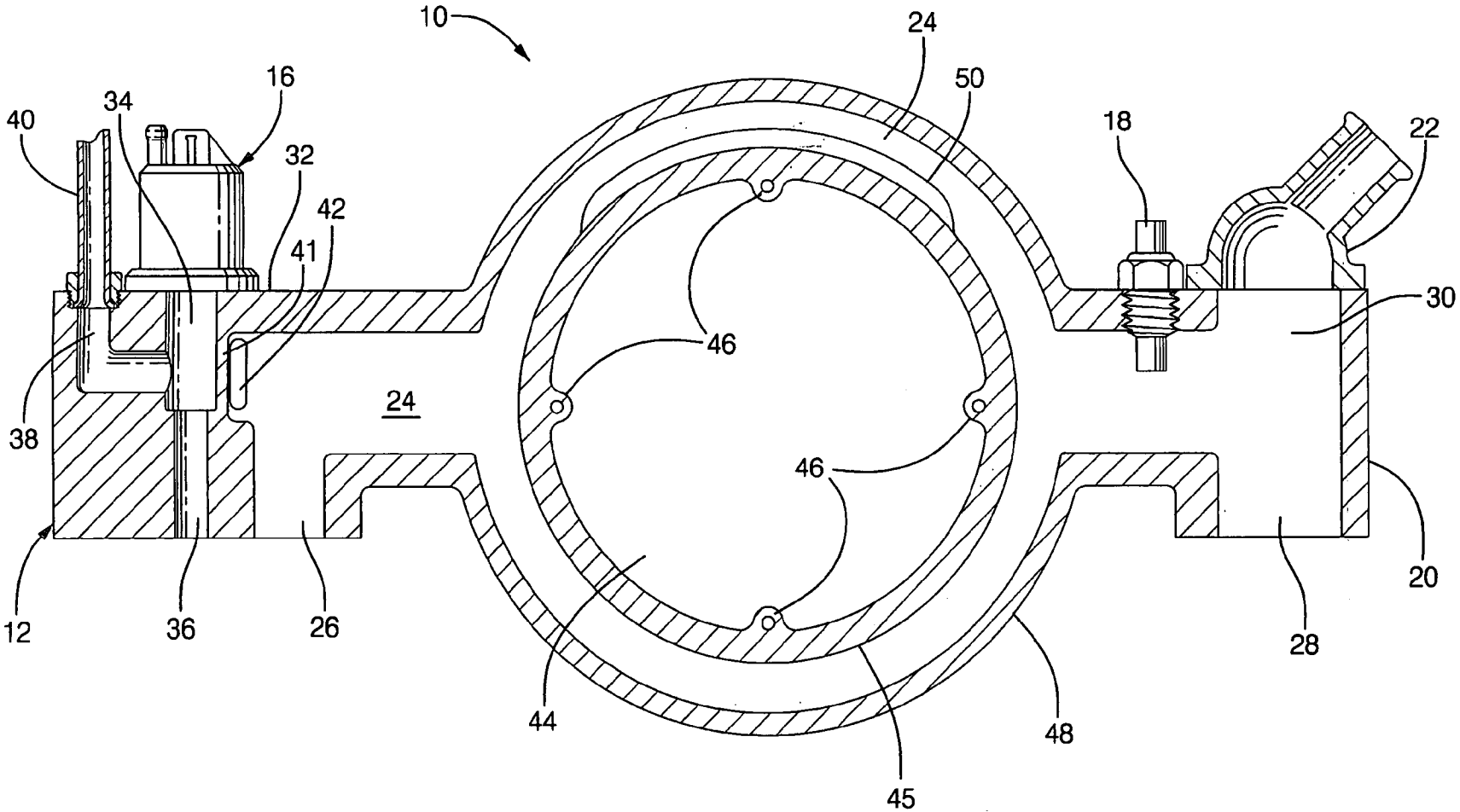
FIG. 2 is a cross-sectional view of the coolant crossover showing the internal coolant passage and some of the components mounted in the crossover.

Referring now to FIG. 2, the conduit member or body 12 defines an internal coolant passage 24 having a coolant inlet 26 at one end and a coolant outlet 28 at the other end, at the bottom of the thermostat housing 20. A second outlet 30 is provided at the top of housing 20 for coolant directed by the thermostat through the cover 22 to the coolant radiator, not shown. The coolant temperature sensor 18 is mounted in the body 12 next to the thermostat housing 20 and extends into the coolant passage 24 for sensing the coolant temperature passing out of the engine.

The inlet end of the crossover member body 12, defines a mount 32 in which the EGR valve 16 is received with a valve body 34 extending into a recess of the mount. An inlet port 36 connects the EGR valve body 34 with a source, not shown, of engine exhaust gas. An outlet port 38 connects the valve body 34 with a conduit 40 leading to an engine manifold intake passage, not shown. A thin wall portion 41 of the mount 32 places the EGR valve body 34 in heat transmitting relation with the coolant passage 24 for carrying heat from the EGR valve to coolant in the passage. The heat rejection may be increased by providing a branch passage 42 for coolant flow, wherein passage 42 at least partially surrounds the EGR valve body 34.

Between the passage inlet 26 and outlet 28, the crossover member 12 includes an enlarged opening 44 defined by an inner wall 45 having a plurality of mounting ears 46. An outer wall 48 is spaced outward of the inner wall and forms semicircular flow paths in the passage 24 carrying coolant around the inner wall 45. The inner wall with the mounting ears 46 forms a mount for the electrical alternator 14, which is received in heat exchange relation with the coolant passage 24 through the inner wall 45. Cooling fins 50 may be provided on the inner wall 45 for increasing heat transfer from the inner wall to the coolant. Preferably, the inner and outer walls 45, 48 form the outer walls of the liquid cooled alternator 14 integrated into the coolant crossover 12. However, the alternator could be provided with a separate outer wall (not shown), which is mounted in the opening 44 for cooling the alternator.

In use, the crossover member 12 is preferably mounted on opposite cylinder heads, or on other members, of a V-type engine with the inlet 26 connected with a port in one cylinder head and the outlet 28 connected with a port in the other cylinder head. Within the crossover 12, the coolant flows from inlet 26 to the EGR valve mount 32 with portion 41 and passage 42. Coolant then passes around the alternator opening 44 and across fins 50 between inner and outer walls 45, 48. The coolant then reaches the temperature sensor 18 and continues to the thermostat housing 20, where it is directed to a radiator bypass through outlet 28 or to the radiator through outlet 30 for cooling of the heated coolant. The crossover member body 12 is made of a suitable thermally conductive material so that the heat of exhaust gases in the EGR valve and the heat produced by the alternator in operation is conducted through the body 12 to the coolant in the passages 24, 42.

Figure 3:
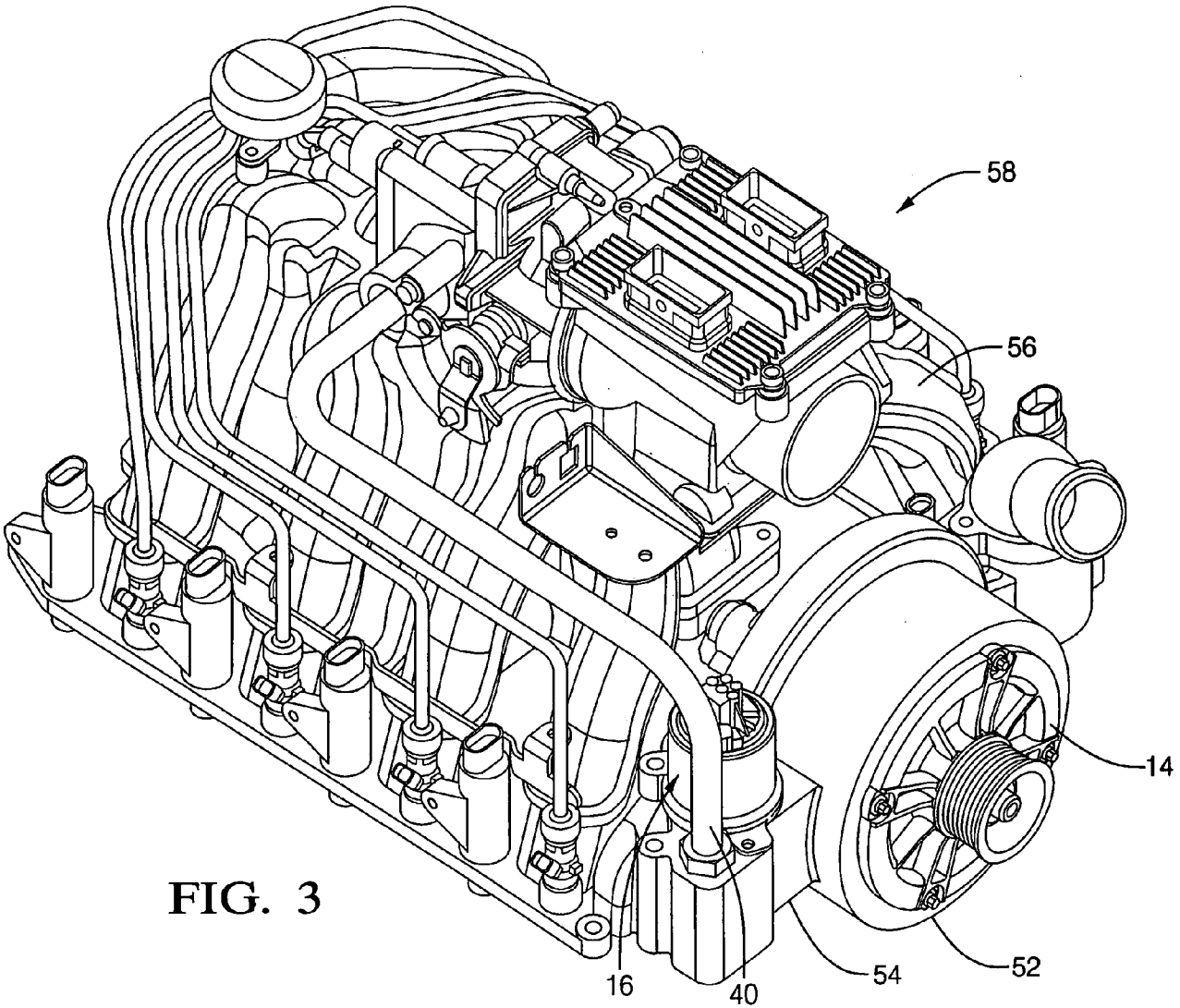
FIG. 3 is a pictorial view showing a coolant crossover as in FIG. 1 integrated into an intake manifold of an integrated air fuel module for mounting on a V-8 engine.

FIG. 3 shows an alternative embodiment of coolant crossover assembly 52 with integrated liquid cooled alternator 14 and liquid cooled exhaust gas recirculation (EGR) valve 16. The liquid cooled alternator 14 is integrated with a coolant crossover 54 that is part of the intake manifold 56 for an integrated air fuel module 58 of a typical V-type internal combustion engine, not shown. The internal geometry of the coolant passage 24 and mounting of the alternator are similar to those shown in FIGS. 1 and 2 previously described. In like fashion an exhaust gas recirculation valve 16 is also integrated into the coolant crossover 54 of the intake manifold 56 and is cooled by the engine coolant via passages in the crossover. Exhaust gas from the EGR valve is discharged through the conduit 40 into the manifold 56.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An external coolant conduit coolant assembly (10) for connection between engine components in a coolant circuit of an engine, said coolant conduit assembly (10) comprising:

a conduit member (12) mountable with said components and defining a coolant passage (24) extending between an inlet (26) and an outlet (28) in the conduit member (12);

an electrical generating device (14) mounted with the conduit member (12) in heat transmitting relation to the coolant passage (24) intermediate the inlet (26) and outlet (28); and a second heat transmitting engine accessory (16) mounted in the conduit member (12) in heat transmitting relation to the coolant passage (24) intermediate the inlet (26) and outlet (28), wherein said conduit member (12) is a crossover for connection between coolant passages in opposite banks of a V-type engine, said crossover also defining a thermostat housing (20) in the coolant passage.

2. An assembly as in claim 1 further comprising a coolant temperature sensor (18) mounted to said crossover and extending into the coolant passage.

* * * * *